US007225557B1

(12) United States Patent
Terban

(10) Patent No.: US 7,225,557 B1
(45) Date of Patent: Jun. 5, 2007

(54) BRACKETLESS BLOTTER

(76) Inventor: Paul L. Terban, 1136 Valter Ct., Forest, VA (US) 24551

( * ) Notice: Subject to any disclaimer, the term of this patent is extended or adjusted under 35 U.S.C. 154(b) by 8 days.

(21) Appl. No.: 11/190,903

(22) Filed: Jul. 28, 2005

(51) Int. Cl.
*B43L 17/08* (2006.01)

(52) U.S. Cl. ..... 34/95.3; 34/95.4

(58) Field of Classification Search ..... 34/95.3, 34/95.4; 269/92–94; D19/98
See application file for complete search history.

(56) References Cited

U.S. PATENT DOCUMENTS

| | | | | |
|---|---|---|---|---|
| 566,356 A | | 8/1896 | Upham | 34/95.3 |
| 701,169 A | | 5/1902 | Dewey | 40/358 |
| 1,405,558 A | * | 2/1922 | Schwartz | 34/95.4 |
| 1,422,555 A | | 7/1922 | Fuller | 34/95.4 |
| 1,437,909 A | | 12/1922 | Peck | 40/358 |
| 2,272,955 A | | 2/1942 | Spitalnik | 120/24 |
| 2,716,963 A | | 9/1955 | Howe | 120/24 |
| 5,915,812 A | | 6/1999 | Terban | 34/95.3 |

* cited by examiner

*Primary Examiner*—S. Gravini
(74) *Attorney, Agent, or Firm*—Thomas Zack

(57) ABSTRACT

A blotter having a flexible blotter backing and a rigid mount with two slanted slots. The ends of the backing are mounted at two opposite side edges into the mount slots along with the edges of the blotting material. Serrations along the edges of the backing are positioned within the mount slots and bear against the ends of the blotting material. The blotter material impacted edges and the inherent flexibility of the backing provide for the firm retention of the blotting material to the mount.

7 Claims, 4 Drawing Sheets

BRACKETLESS BLOTTER

BACKGROUND OF THE INVENTION

Blotter configurations consists of many types and varieties. Most blotters have a mounting backing surface for the blotter paper or an intermediate blotter paper backing on which the paper bears against and is interposed between the mounting backing and the blotter paper. The supporting backing surface may be rocker-shaped and may be held along with the blotter paper to the mounting backing surface in a variety of ways. One of the ways used to hold the mount backing surface to the blotting surface is to have the ends of the holding members curved, or to have holding flanges, springs, straps, glue, triangular corner pockets, clamping plates, etc. Each holding methods and apparatuses for retaining the blotter paper to its backing has merits and disadvantages. My previous invention entitled Rocker Blotter (U.S. Pat. No. 5,915,812) describes in detail some embodiments of such methods. The present invention seeks to simplify and improve upon the previously used methods and apparatuses used to hold the blotting paper and its backing to a mount by providing for two opposed slanted facing end slots into which the ends of a flexible backing with holding surfaces engage the blocking paper to prevent lateral movement. This occurs while the backing ends and paper ends are each seated within the end slots as described in detail herein.

DESCRIPTION OF THE PRIOR ART

The prior art describes different types of methods or apparatuses that are used to hold blotter material or blotting paper to a backing surface. For example, in U.S. Pat. No. 566,356 to Upham, the backing, handle or blotter holder A, has end abutments folded down and inward that engage the ends of the blotters B. The U.S. patent to Dewey (U.S. Pat. No. 701,169) also has a backing with clip ends B that form open pockets that receive and hold the ends of the blotting paper or sheets E. Another reference (U.S. Pat. No. 1,422,555) to Fuller discloses a backing 10 with raised transverse ridges 11 that are curved at their outer edges unto loops 12. The felt pad 24 receives the blotting paper or material with the ends of the recesses 15 used to hold them together. In U.S. Pat. No. 1,437,909 to Peck a blotter 1 has end flanges 2. A plate 3 holds the blotter 4 in place against the flanges 2. The Spitalnik patent (U.S. Pat. No. 2,272,955) describes a frame with longitudinal grooves on the bottom at either side of the frame. The blotting paper 24 fits over the arcuate bottom wall 20 the ends of which members fit into the grooves. Another reference, U.S. Pat. No. 2,716,963 to Howe, also has end slots 10 that receive protuberances 11 forced into the ends of body 5.

In my prior patent, U.S. Pat. No. 5,915,812 to Terban (hereinafter referred to a patent 812), a flexible backing 3 has opposite ends that fit into raised lips 21 and 23 in an internal bracket glued inside a mount. None of these references or the prior art describes a blotter mount having end slots that receive a backing material with means to prevent the lateral movement of the backing within the slot and to firmly hold the blotting paper or material in the slots as further set forth in this specification.

SUMMARY OF THE INVENTION

This invention relates to a blotter having a flexible blotter backing and mount. There are means formed in the backing to prevent the lateral movement of retained blotting paper.

This occurs when the end of the backing and paper are placed in slanted slots in the mount. Serrations along the two ends of the backing act to hold the blotting paper in place when inserted into the mount slots.

It is the primary object of the present invention to provide for an improved blotter backing which has means to prevent the lateral movement of the retained backing and blotter material when their ends are held in mount slots. This objective is accomplished while eliminating the internal bracket raised lips disclosed in my earlier mentioned patent.

Another object is to provide for such an apparatus wherein the backing and blotter material are held in place to the mounting plate solely by the interaction of the modified backing when placed in mounting plate receptors.

These and other objects and advantages of the present invention will become apparent to readers from a consideration of the ensuing description and the accompanying drawings.

DESCRIPTION OF THE PREFERRED EMBODIMENT

Figure 1:
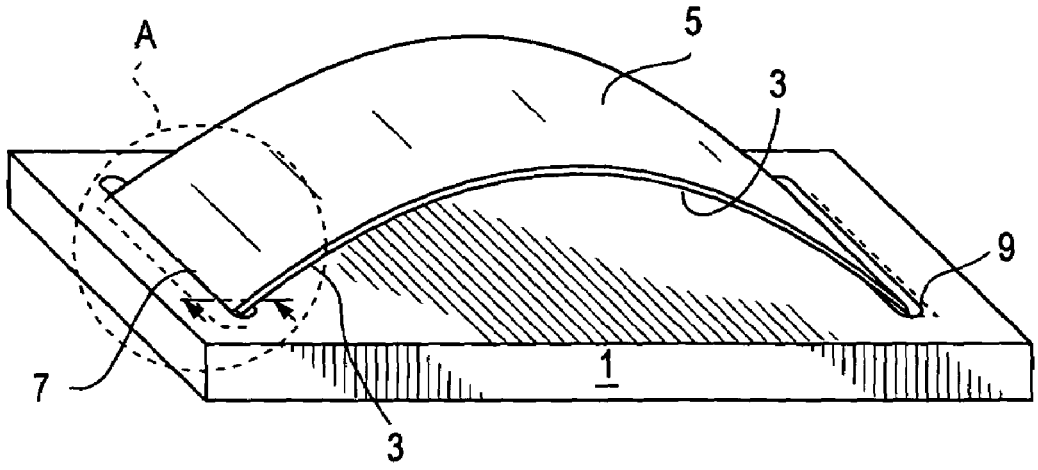
FIG. 1 is a perspective view of the invention's preferred embodiment.

FIG. 1 is a perspective view of the invention's preferred embodiment. The invention consists of a mounting plate or mount 1, the backing 3, and the blotter material 5. The mounting plate 1 has two slots 7,9 (see FIG. 2) that extend laterally into the plate body and are adjacent the ends of the plate. The slots 7,9 extend substantially across the width of the plate 1 and are generally parallel to each other. The backing 3 is made of a flexible sheet material and has a surface area that is generally coextensive with the area of the blotting material 5. The blotting material 5 is mounted over the outside surface of the backing 3. The mounting plate 1 acts to retain the ends of the backing 3 and blotting material 5 within the two opposite ends slots 7,9. When so inserted, the blotting material and backing are both retained without the need for any additional bracket support.

Figure 2:
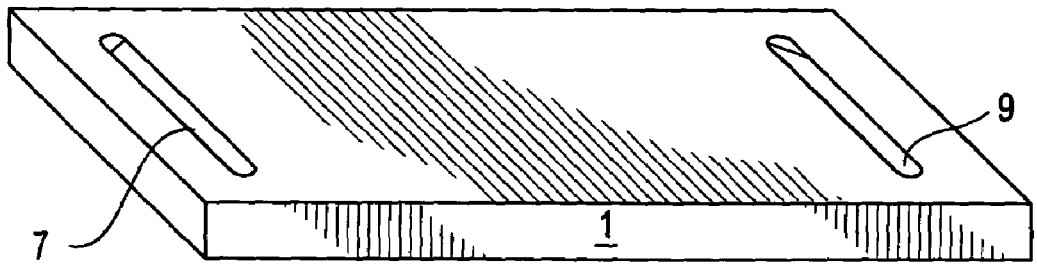
FIG. 2 is a perspective view of the mounting member used in the preferred embodiment.

FIG. 2 is a perspective view of the mounting plate or member 1 used in the FIG. 1 embodiment. This mounting plate acts as a handle for a user when turned upside down with the blotting material facing towards the work surface. If desired, an optional knob handle (e.g., knob 15 of my patent 812) could be added to the mounting plate 1 for the user. The two end slots 7,9 are each internally slanted. The two slots are located on opposite ends of the mount and extend partially, but not totally, through the thickness of the mounting plate 1. The slots are substantially identical to each other in depth, length, and width. The slanted angles are the same but directed in opposite directions. There are small end sections 11,13 of the mounting plate 1 between the plate ends and the lateral or width of the slots. While shown rectangular in configuration, the mounting plate 1 could assume other shapes all within the purview of this invention.

Figure 3:
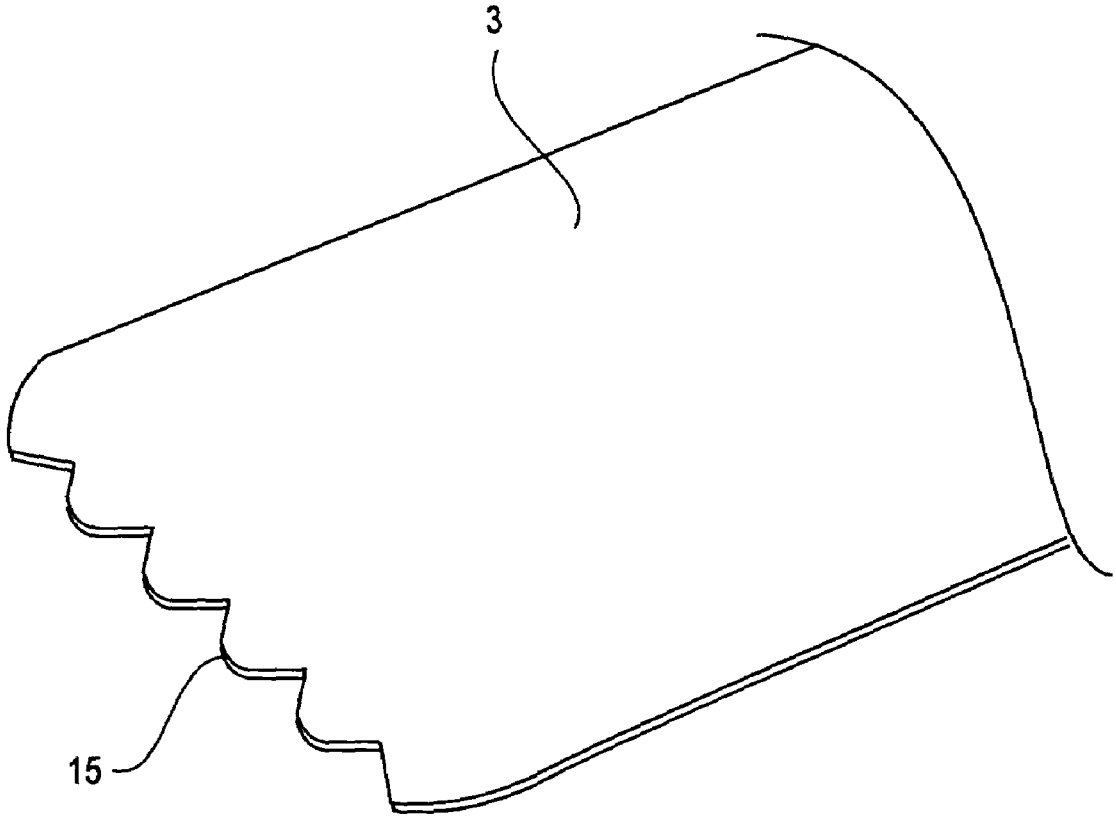
FIG. 3 is an enlarged perspective view of one of the serrated ends of the backing used in the FIG. 1 embodiment.

FIG. 3 is an enlarged perspective view of one of two ends of the backing 3 shown in the FIG. 1 embodiment. The overlapping blotting material 3 is absent in this figure. Located along the two identical ends or tip of the backing 3 are the serrations 15. Serrations 15 consist of a series of end rough edge surfaces. In the embodiment shown, the serrations consist of six triangular shaped edges with indentations between each of them. The serrations 15 act to retain the engaged blotting material in place by preventing lateral or side to side movement of the blotting material when both backing and blotting material have their respective ends placed in the mount slots 7,9. The shown backing 3 may be made of a curved rectangular shaped rocker-shaped pliable metal material whose two opposite ends are dimensioned and shaped to fit, along with the blotter material ends, snugly within the two slots formed in the mount. When the backing 3 ends are positioned in each of the end slots 7,9, the inherent flexibility of the backing exerts a downward and outward force on the blotting material to hold the same in place.

Figure 4:
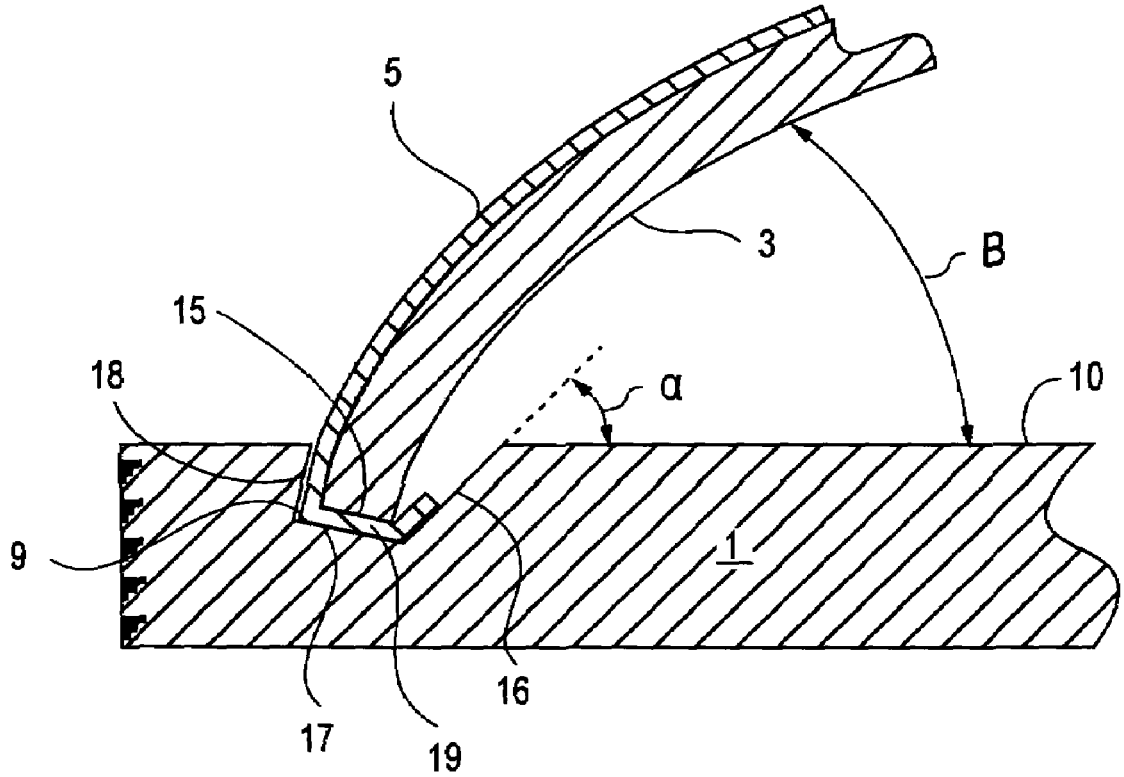
FIG. 4 is an enlarged cross sectional view of the area shown in circle A of FIG. 1 showing the engagement of the backing and blotter material ends within a mount slot.

FIG. 4 is an enlarged cross sectional view of the area shown in circle A of the FIG. 1 showing the engagement of the backing end and blotter material end within one of the two mount slots (7). The other mount slot 9 would have a similar mirror image configuration to retain the opposite ends of the backing and blotting material. Normally the blotting material or paper 5 is slightly larger in total surface area than the backing 3 with the same general shape. Along the outer surface area of the backing the blotting material 3 bears directly against the outside surface of the backing member in an overlapping manner. Each slot 7,9 has two mount sides 16,18 which extend downwardly and outwardly from the upper mount surface 10. As shown in FIG. 4, a straight line extending from slot side (16) to outside the mount makes the angle $\alpha$ with respect to the upper mount flat surface 10. The two slot sides each are angled at the same angle $\alpha$ which is about 30 degrees. When an end of the backing 3 is mounted into each slot, the backing material just outside the mount adjacent the slot is bent to an to an angle B. Angle B is normally greater than the slot side angle $\alpha$. The angle B is measured external to the slot as shown in FIG. 4. The backing material flexibility allows for this stressed or distorted state for the backing material adjacent the two slots. Typically, the angle B made by the backing material changes as it is measured along the length of the backing from adjacent the slot end to the highest point of the backing above the upper surface of the mount.

The two slots sides 16,18 do not extend totally through the thickness or height of the body of mounting plate 1 but have a lower bottom 17 formed in the mount body 1. The end edge of the blotting material or paper 5 extends slightly past the end of the backing 3 such that the blotting material has an end tab portion 19 which fits under the lower end of the backing 3 at the slot bottom 17. The blotter material may extend past the end of the backing end and slightly up the opposite backing side as shown. Combined with the downward and outward force exerted by the flexible backing, the blotting material ends are pressed against the sides and bottom of the two retaining slots. The lower tab 19 insures the blotting material is retained in a firm manner by the bent and inserted backing ends. The backing end serrations 15 (see FIG. 5) engage the lower ends 19 of the blotting material and, along with the downward pressure exerted by the backing inserted into each of the two slots, prevent lateral blotting material movement within the widths of the two retaining slots 7,9. As a user holds the mount 1 in his or her hand and exerts a downward pressure on a supporting surface (not shown) for the written material, both the backing and the retained blotting material are firmly held in place within their respective two mount slots against the surface of the backing. The natural resiliency of the material making up the backing 3 is what acts to retain the backing within the confines of the side slots while the backing retains with its serrated ends prevents lateral movement of the blotting material. The blotting material that is within the slots is compressed to some extent by the pressure of the backing material against the two slot sides and slot bottom 17.

Figure 5:
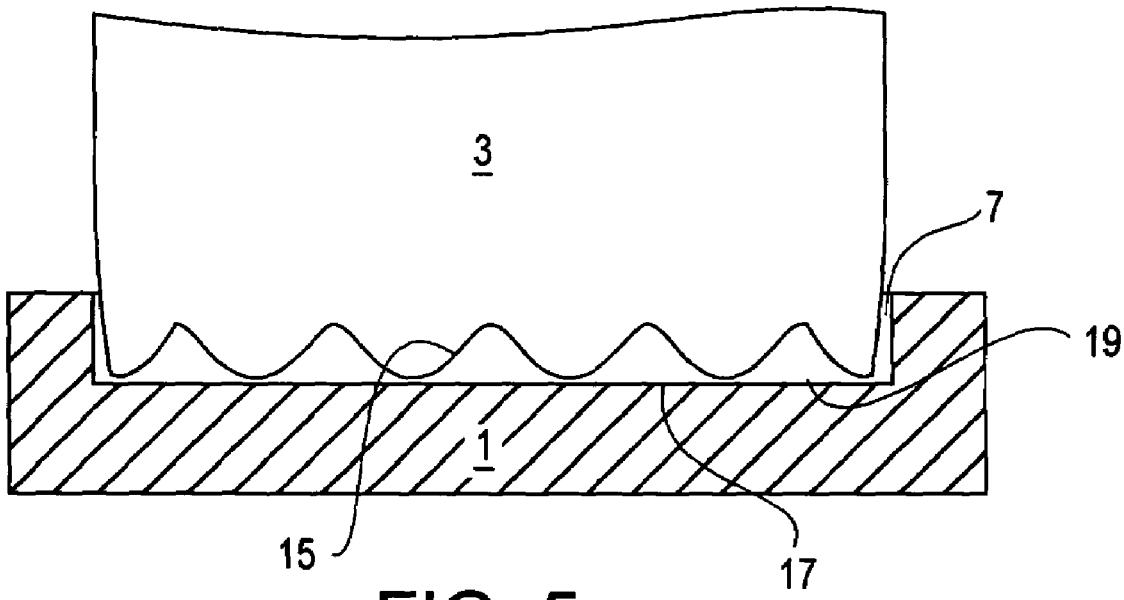
FIG. 5 is a schematic view of the backing and blotter material end when inserted into a mount slot.

FIG. 5 is a schematic view of the backing 3 end when inserted into one of the two slots 7,9 slot of mount 1. This view is taken about 90 degrees from the cross sectional side view of FIG. 4. In FIG. 5 slot 7 has been selected. When the other end of the backing 3 is in slot 9, the depicted view would be the same when viewed from an opposite direction. The vertical surface of the blotting material 5 has been omitted in this view and only the lower tab portion 19 of the same shown. The lower end of backing 3 extends into slot 7 and normally would bear against the bottom surface 17. However, interposed between the backing serrations 15 and the bottom mount slot surface is the blotting material tab end 19. With this arrangement, the backing material is held firmly and prevented from moving either horizontally in the slot or vertically out of the slot.

The mounting plate 1 may be made of any commonly used rigid material such as wood, acrylic, metal, etc. as desired. The blotting material 5 could be any paper product or any material commonly used absorbent material used for blotting ink or similar writing materials. Initially, a user places the blotting material over and against the outside surface of the backing 3 in a taut manner with two end tabs 19 extending over the lower ends of the backing. Then, the combination at each end are pressed into the two slots one side at a time. To remove or replace the blotting material 5 from the backing 3, one of the two ends of the backing and its associated inserted blotting material end is simply pulled out of one of the retaining mount slots which action deceases the retaining pressures and permits the easy backing removal from the other slot, now not under tension. Normally both the blotting material 5 and backing 3 are thin sheet members that are flexible. Other means within the confines of the two slots 7,9 could be employed to assist in retaining the ends of the backing and blotting material therein. For example, the backing ends could have one or more small bumps on their end side surfaces which engage the blotting material portions that are within the slots.

The slots can be routed at the described degree angle $\alpha$ using a computer-driven router, called a computerized numerically-controlled (CNC) router. Typically the slot sides have an internal mount angle $\alpha$ that is fixed and about 30 degrees. The inherent lack of flexibility of the rigid mounting plate 1 allows the flexible backing material to have the angle B changed when this angle is measured along the exterior length of the backing. Adjacent the slots and exterior therefrom the backing angle B when measured would be about 50 degrees. The measured angle B would gradually increase as it goes towards the zenith or highest backing portion of the bent backing above the mount surface 10. As stated before, the angle $\alpha$ defining the sides of the two slots is fixed and extends downwardly and outwardly from the mount surface.

Although the preferred embodiment of the present invention and the method of using the same have been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

The invention claimed is:

1. A blotter apparatus comprising:

a mount having a length and a width, said mount having two slanted slots extending into and substantially across most of the width of the mount;

a backing having two opposite ends, one of said two opposite backing ends being mounted into each of the two mount slanted slots;

blotting material overlapping the backing, said blotting material having opposite ends that are insertable into each of the mount slanted slots with the two backing ends; and means on the backing located adjacent to the backing ends preventing the lateral movement of the backing and blotting material when their respective ends are mounted into the two mount slanted slots.

2. The blotter apparatus of claim 1, wherein said means on the backing preventing-lateral movement comprises rough edge surfaces on the backing.

3. The blotter apparatus of claim 2, wherein said mount has a thickness, said slanted slots not extending through the thickness of the mount and not across the total width of the mount.

4. The blotter apparatus of claim 3, wherein the mount has an upper surface with each of the slanted slots having two sides that are each formed at a downwardly and outwardly facing angle with respect to the mount upper surface.

5. The blotter apparatus of claim 4, wherein the formed side angles of said slanted slots are each about 30 degrees from the upper surface of the mount.

6. The blotter apparatus of claim 5, wherein said backing when mounted in the slanted slots forms an angle with the upper surface of the mount adjacent said upper surface greater than the side slanted slot angles.

7. The blotter apparatus of claim 6, wherein said formed angle of the backing with respect to the upper surface of the mount is variable along the length of the backing and about 50 degrees adjacent the slanted slots.

* * * * *